US006634443B1

(12) United States Patent
Paech et al.

(10) Patent No.: US 6,634,443 B1
(45) Date of Patent: Oct. 21, 2003

(54) DRILL ROD HANDLING DEVICE

(75) Inventors: Ivor Neil Paech, Christies Beach (AU); Stephen Alfred Muller, Clearview (AU)

(73) Assignee: Boart Longyear Pty. Ltd., Mitchell Park (AU)

( * ) Notice: Subject to any disclaimer, the term of this patent is extended or adjusted under 35 U.S.C. 154(b) by 0 days.

(21) Appl. No.: 10/009,255

(22) PCT Filed: Apr. 18, 2000

(86) PCT No.: PCT/AU00/00330

§ 371 (c)(1),
(2), (4) Date: Oct. 19, 2001

(87) PCT Pub. No.: WO00/65193

PCT Pub. Date: Nov. 2, 2000

(30) Foreign Application Priority Data

Apr. 28, 1999 (AU) ..... PP 9999

(51) Int. Cl.[7] ..... E21B 19/087; E21B 19/20
(52) U.S. Cl. ..... 175/85; 414/22.54; 414/735
(58) Field of Search ..... 175/85, 52; 166/85.1; 414/22.54, 22.58, 22.61, 735, 746.8

(56) References Cited

U.S. PATENT DOCUMENTS 4,280,785 A * 7/1981 Albrecht ..... 414/735
4,449,596 A * 5/1984 Boyadjieff ..... 175/85
4,718,805 A * 1/1988 Becker ..... 414/22.54
4,834,604 A * 5/1989 Brittain et al. ..... 414/22.55
5,049,020 A * 9/1991 McArthur ..... 414/22.51
5,575,344 A * 11/1996 Wireman ..... 175/85
5,941,324 A * 8/1999 Bennett ..... 175/85

FOREIGN PATENT DOCUMENTS

DE 29903909 U1 * 10/1999 ..... E21B/7/02
JP 06235216 A * 8/1994 ..... E02D/5/80

* cited by examiner

*Primary Examiner*—David Bagnell
*Assistant Examiner*—Shane Bomar

(57) ABSTRACT

The invention provides a drill rod handling device (14) which is adapted for attachment to a drill rig assembly (10) which includes a standard rotation unit (12) and a rod holder (13) mounted on top of a feed frame (11) and which are used to feed drill rods (25) in and out of the ground. The handling device (14) comprises a carriage assembly (20) which is guided for sliding movement along slide members (19), a head assembly (24) which is designed to receive and support a drill rod (25) and to feed the drill rod longitudinally for screwing and unscrewing of the thread joint while simultaneously gripping same, a swing arm (21) pivotally attached to the carriage assembly and extending laterally therefrom, swivel attachment means rotatably mounting the head assembly (24) to the outer end of the swing arm (21) for tilt movement about a transverse axis, a swing arm actuator (38) for effecting rotation of the swing arm (21) and the head assembly (24) about a generally longitudinally axis, and a tilt actuator (42) for effecting tilt of the head assembly (24), the arrangement being such that a drill rod (25) when loaded onto the head assembly (24) at a side low position, can be bodily moved to a loading position on top of the feed frame and axially aligned with the drill string.

11 Claims, 7 Drawing Sheets

DRILL ROD HANDLING DEVICE

BACKGROUND OF THE INVENTION

This invention relates to an improved drill rod handling device which is designed for attachment to a drill rig feed frame and which facilitates the handling of drill rods during the drilling operation.

It is common practice for drill rods (including kelly rods and core barrels) to be handled manually when transferring same from a rod rack to a position on the feed frame of a conventional drill rig for being coupled to a drill string (and also when removing the rods therefrom). The rods are coupled to a rotation unit and rod holder, which are standard parts of a conventional drill assembly mounted on-top of the feed frame, and are used to feed rods in and out of the ground. Such manual handling is particularly undesirable in situations where heavy drill rods are required to be handled and lifted at awkward angles and heights in a repetitive manner.

While it is also known for the drill rods to be handled automatically by an automatic rod handler with little manual input being required, such equipment is generally very expensive.

There is a need therefore for a rod handling device which avoids the problems associated with solely manual rod handling procedures, and is able to offer advantages similar to those achieved by the automatic rod handlers yet is far less costly, and which will allow drilling operator(s) to handle a large number of drill rods with less chance of fatigue and injury.

SUMMARY OF THE INVENTION

It is the main object therefore of the present invention to provide an improved rod handling device which avoids the need for a drill assistant to manually lift and manipulate the drill rods onto the feed frame of the drill rig, is simple in its operation and of relatively low cost.

It is another object of the present invention to provide an improved rod handling device which is ergonomically better for the drilling assistant than a conventional manual procedure and will allow the assistant to handle a large number of drill rods with less chance of fatigue and injury.

It is a further object of the present invention to provide an improved rod handling device in the form of an attachment which can be readily attached to the feed frame of a standard drill assembly.

According to this invention therefore, a drill rod handling device is adapted for attachment to a feed frame of a drill rig assembly which includes a standard rotation unit and a rod holder mounted on top of the feed frame and which are used to feed drill rods in and out of the ground, said handling device comprising:

elongate guide means which extend longitudinally of the feed frame along one side thereof;

mounting means for attaching said guide means to said feed frame;

a carriage assembly arranged for sliding movement lengthwise along said guide means;

a head assembly comprising a head support frame, holder means for supporting a drill rod at spaced apart locations along its length, gripper means for gripping the drill rod, when supported by said holder means, during transport of the rod from the load/unload position to its make/break position and also during the rod screwing function, and means for feeding the drill rod longitudinally when supported by the holder means;

a pivotal swing arm pivotally supported on said carriage assembly and operatively interconnecting said carriage assembly and said head assembly, swivel attachment means rotatably mounting the head assembly to the outer end of said swing arm for tilt movement about a transverse axis, tilt actuator means for effecting said tilt movement of said head assembly, and swing actuator means for effecting bodily rotation of said swing arm and said head assembly about a generally longitudinal axis, arranged and constructed so that a drill rod when loaded (eg, manually) onto the head assembly at a side load position relative to the feed frame, can be bodily moved to a loading position on top of the feed frame.

Desirably the swing actuator rotates the swing arm and head assembly through an arc of at least 180°, with the arc movement allowing the swing arm to be swung in behind the rotation unit on the feed frame.

Desirably the guide means comprises a pair of parallel spaced apart elongate guide rails or rods along which the carriage assembly is guided for sliding movement by means of slides. Preferably the power drive means for the carriage assembly comprises an hydraulic traverse cylinder arranged so that it can move the swing arm and head assembly to a position far enough away from the load/unload position so that they clear the back of the rotation unit on the feed frame and the rod string when making and breaking threads.

Preferably there are two opposing pivotal rod gripping jaws on the head assembly and which house respective roller assemblies. The rod gripping jaws are open and closed by means of an hydraulic cylinder.

Preferably, some of the rollers of the roller assemblies are rotated by means of hydraulic motors which may run continuously. When rotating, the rollers feed the drill rod axially for screwing and unscrewing of the thread joint while simultaneously holding the rod.

Desirably each of the guides of the guide assemblies have provisions for holding a drill rod or outer tube for a given rod size.

Desirably the rod handling device of this invention is powered hydraulically from the power pack of the drill rig and is operated by a remote electric control panel. The device preferably includes an hydraulic directional control valve which uses electric solenoids to control individual valve movements.

BRIEF DESCRIPTION OF THE SEVERAL VIEWS OF THE DRAWINGS

In order to more fully explain the present invention, a preferred embodiment is described hereunder in some further detail with reference to the accompanying drawings wherein:

FIG. 6 is a fragmentary, exploded view of the carriage assembly and its attachment to the swing arm; while

DETAILED DESCRIPTION OF THE INVENTION

Figure 1:
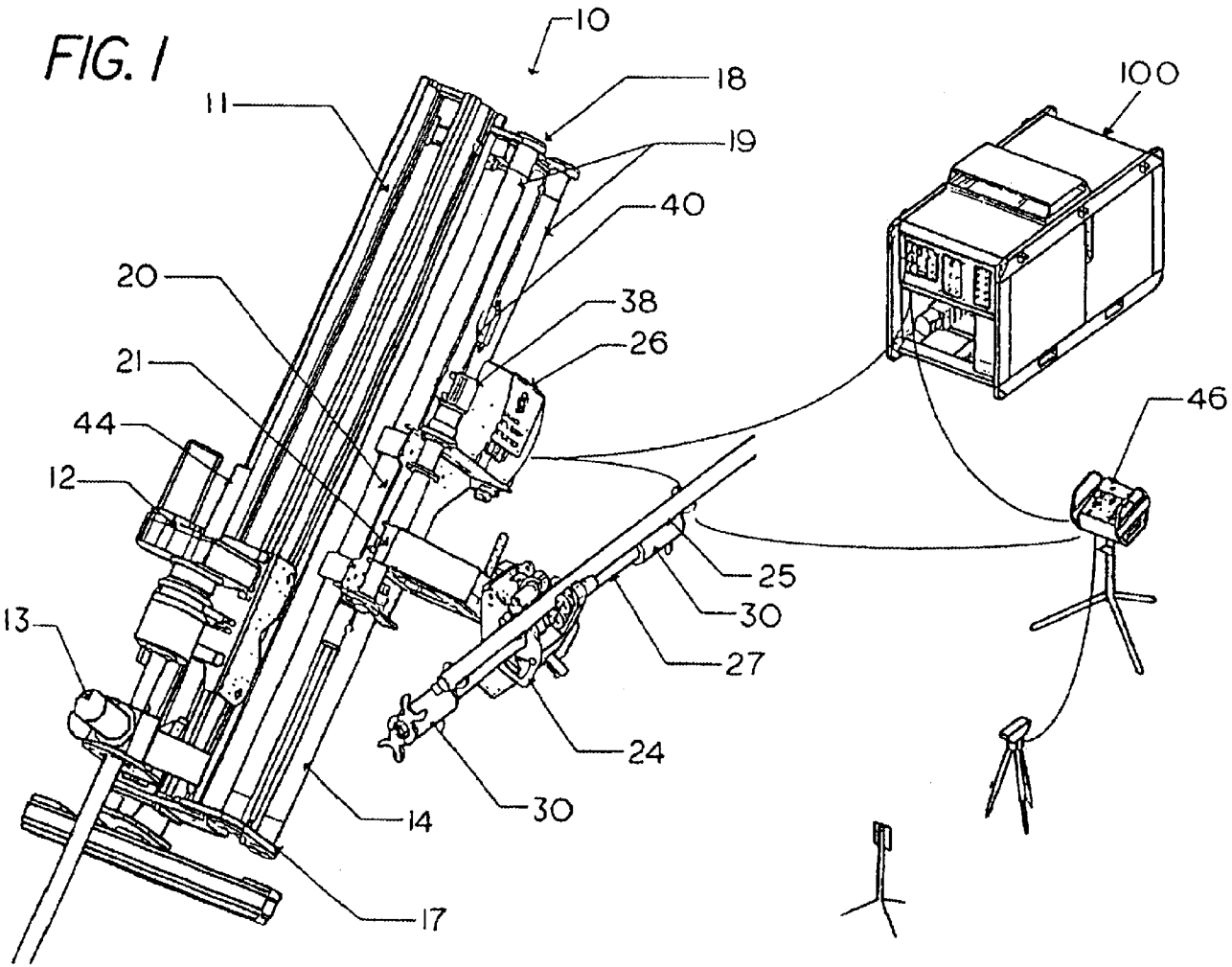
FIG. 1 is a perspective view of a rod handling device, according to a preferred embodiment of the invention, attached to the feed frame of a standard drilling rig.
Figure 2:
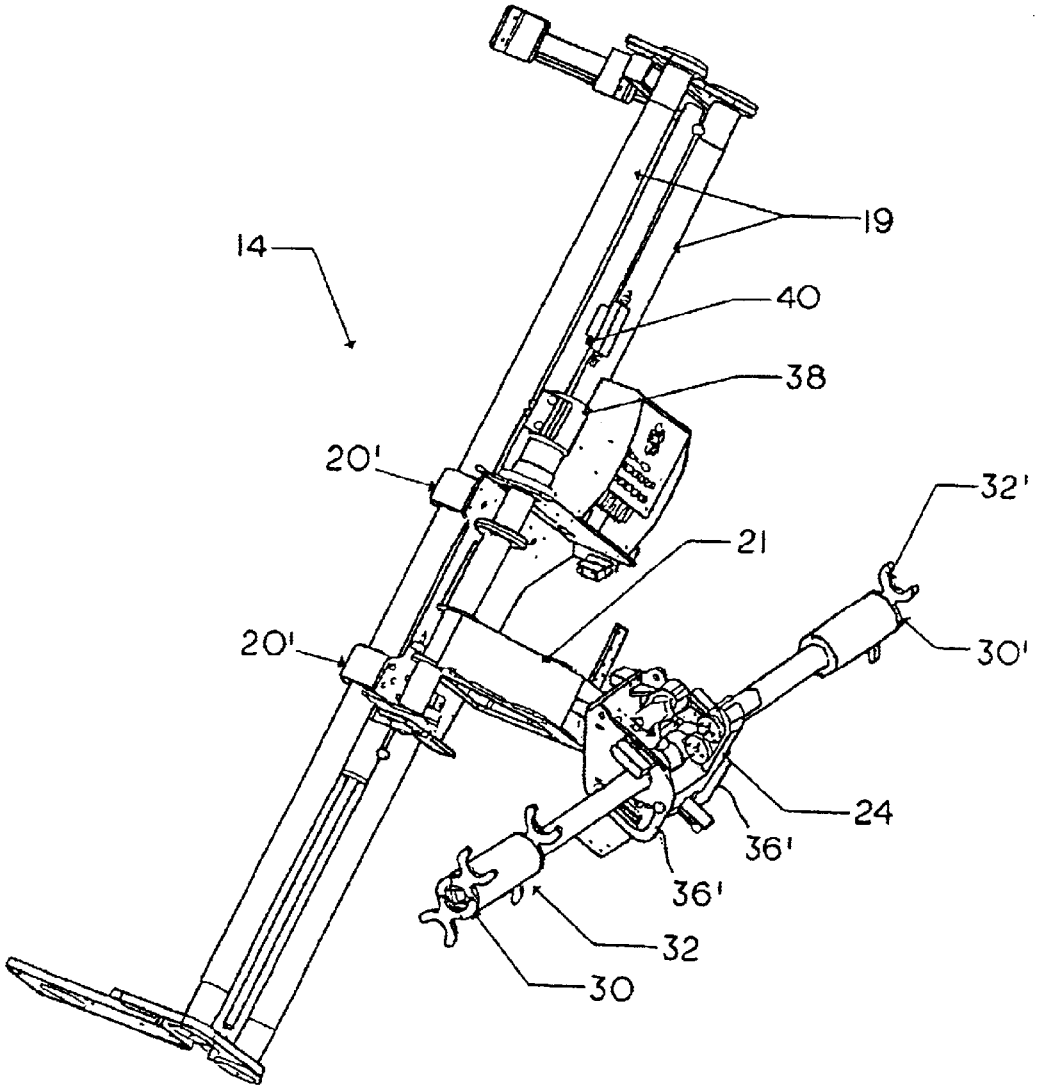
FIG. 2 is a perspective view, similar to that of FIG. 1, showing the rod handling device detached from the feed frame.
Figure 3:
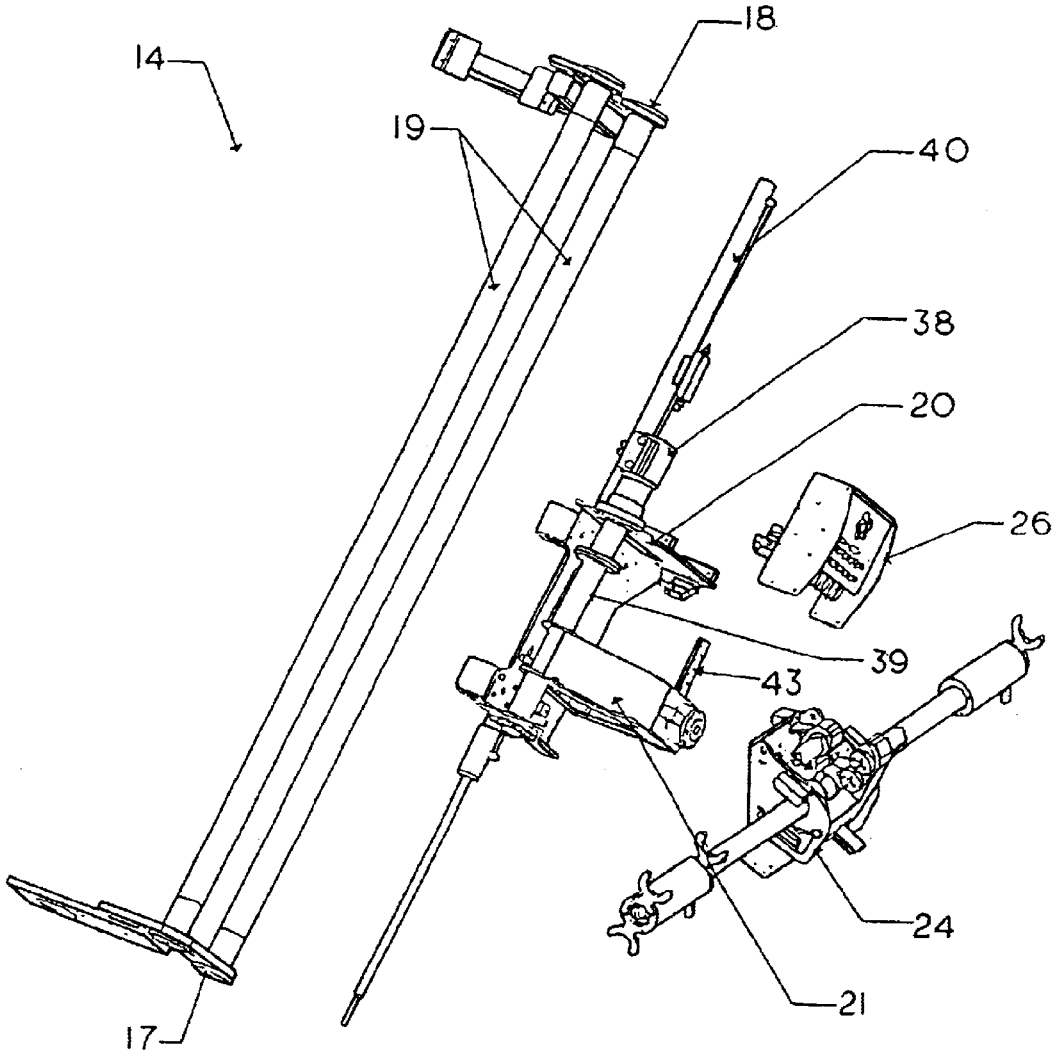
FIG. 3 is an exploded perspective view of the rod handling assembly shown in FIG. 2.

Referring to the drawings, there is shown a drill rig assembly 10 which comprises an upwardly inclined elongate feed frame 11, a standard rotation unit 12 and standard rod holder 13 mounted on top of the feed frame 11 and which are used to feed drill rods in and out of the ground, and a rod handling attachment unit 14 which is attached to the feed frame 11 to one side thereof and which is used to assist the transfer of drill rods, kelly rods and core barrels onto and from the drill rig from behind the rotation unit 12—although it can also be used to transfer drill rods of relatively short length to and from the drill rig from in front of the rotation unit. The attachment unit 14 comprises the following elements:

(a) Front and rear mounts 17,18 which allow the unit 14 to be rigidly attached to the feed frame 11;

(b) A pair of spaced apart parallel carriage engaging guide rails 19 which extend lengthwise of and parallel to the longitudinal axis of the feed frame 11;

(c) A carriage 20 which is guided by means of slides 20' for sliding movement along the rails 19;

(d) A laterally projecting swing arm 21 which is mounted on the carriage 20 for pivotal movement about an axis parallel to the lengthwise axis of the feed frame 11;

(e) A head assembly 24 swivelably mounted at the free end of the swing arm 21 and which is designed to locate and grip a drill rod 25 loaded thereonto by a drilling assistant from a stack of drill rods which are supported in a rod rack located in proximity to the drilling rig;

(f) An hydraulic directional control valve assembly 26 mounted at one end of the carriage 20 and which employs electric solenoids to control individual valve movements during operation of the device 14.

Figure 4:
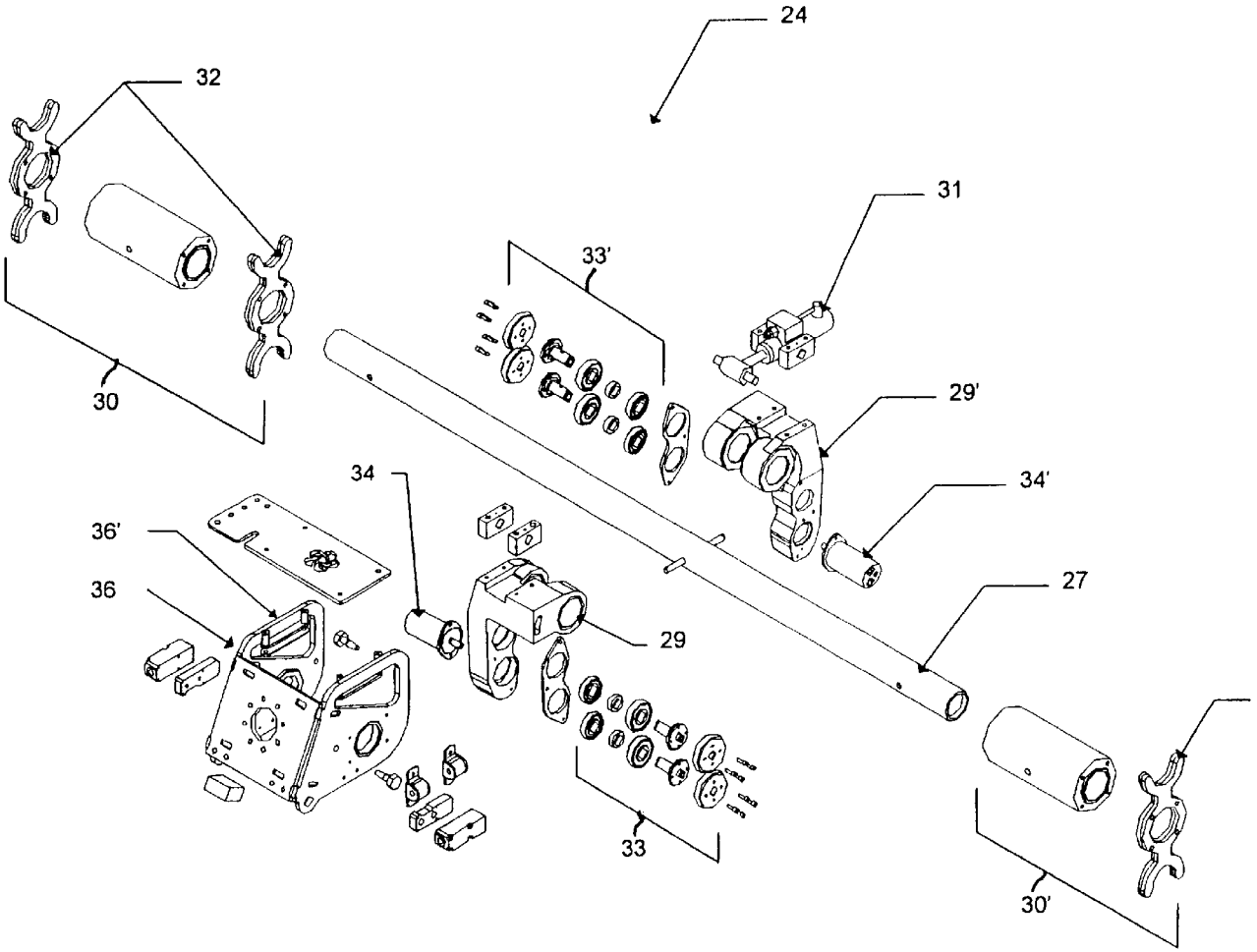
FIG. 4 is an exploded perspective view of the head assembly of the rod handling device.
Figure 5:
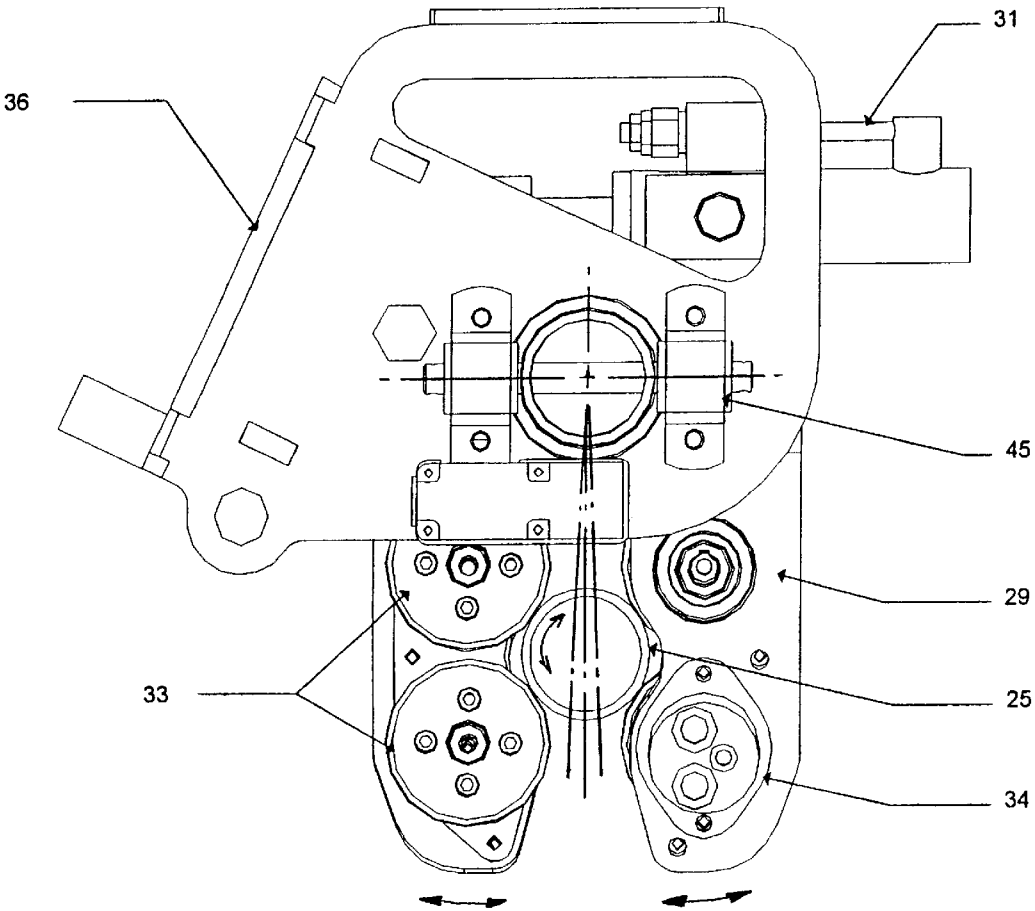
FIG. 5 is an end view of the head assembly with a drill rod clamped therein.
Figure 6:
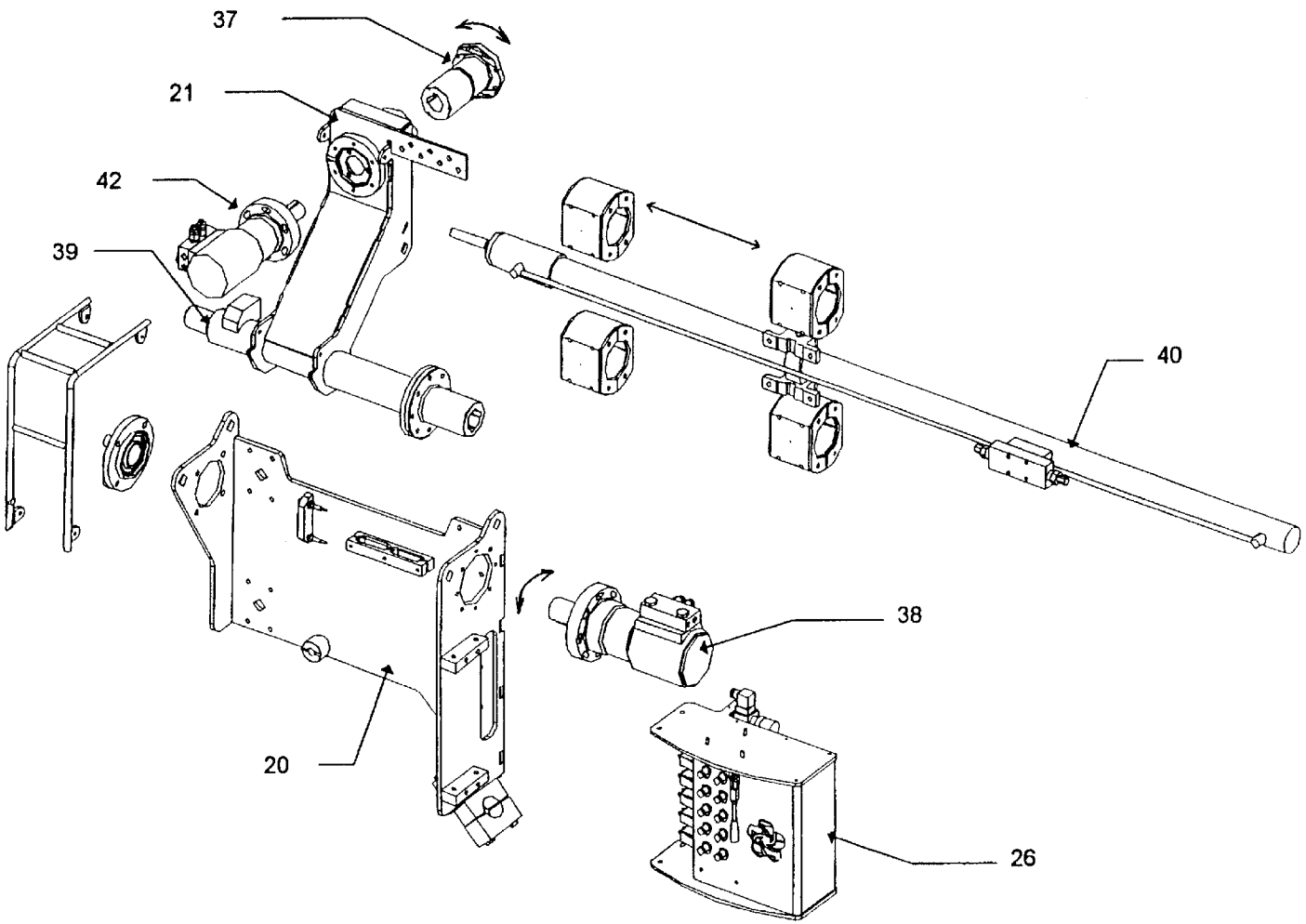

The head assembly 24 comprises an elongate support arm 27 (which can be formed as a single member or as two co-axial members extending to either side of the head assembly), and a pair of opposing rod gripper assemblies 29 (refer FIG. 4) which are arranged to hold a drill rod 25 in the head assembly during its transport from the load/unload position to the make/break position and also, when performing the rod screwing function. The grippers 29 are mounted on an inclined angle similar to the helix of the threads used on the drill rods and are actuated by means of an hydraulic cylinder 31. The support arm 27 has mounted at its outer opposite ends, drill rod guide assemblies 30, 30' which include one or two radial U-shaped holders 32, 32' for holding a drill rod for a given rod size. Individual guides are sized to suit each rod size and can be conveniently fitted to the outer ends of the support arm 27 and clamped thereon.

The head assembly 24 also comprises a plurality of rollers 33, 33' which are rotated via two hydraulic motors 34, 34' which can run continuously. When rotating, the rollers feed the drill rod 25 axially for screwing and unscrewing of the thread joint as well as supporting it intermediate its length. In this embodiment the rollers 33, 33' are housed within the gripper assemblies 29, 29'.

In order to bodily rotate the swing arm 21 and the head assembly 24 about an axis parallel to the longitudinal axis of the feed frame, there is provided an hydraulic swing arm actuator 38 which is mounted at one end of a shaft 39 which itself is journalled for rotation on the carriage 20. In this embodiment actuator 38 rotates the swing arm 21 and in turn the head assembly 24 about the axis of shaft 39 through an arc of 180° which allows the drill rod 25 to be transported to its make/break position on the feed frame 11 from behind (or in some cases, in front of) the rotation unit 12 on the feed frame 11. Position sensing devices are incorporated for determining the location of the swing arm 21.

In order to effect movement of the carriage assembly 20, and in turn the swing arm 21 and head assembly 24, lengthwise along the guide rails 19, there is provided an hydraulic traverse cylinder 40 which is arranged to bodily move a drill rod being transported by the head assembly 24 far enough back from the load/unload position so that they clear the back of the rotation unit 12 and the rod string when making and breaking threads. A linear position sensing device for determining the location of the carriage 20 may be incorporated into the carriage 20.

The head assembly 24 comprises a support frame 36 swivelably mounted to the outer end of the swing arm 21 by means of a pivot shaft 37, the support frame 36 having laterally projecting side plates 36' which are provided with circular openings sized to receive support arm 27. The swivel connection between the head assembly 24 and the swing arm 21 permits the head assembly to rotate about a generally transverse axis. In this embodiment, a tilt actuator 42 effects tilt of the head assembly 24 through an arc of 180°. This allows a drill rod to be loaded at any angle from vertically up to vertically down with the feed frame 11. A mechanical stop 43 can be used to limit the movement to 90° when drilling up or down holes. This function may have provision for angular position sensing by means of a suitable sensor designed to control the extent of swinging movement of the head assembly 24 within predetermined limits.

As previously described, the head assembly 24 is able to bodily rotate about a generally perpendicular axis with respect to the axis of the carriage 20—this feature allowing the support arm 27, the gripper assemblies 29 and guide assemblies 30 to oscillate as a single unit. A self centering device 45 is fitted to the head assembly 24 in order to facilitate the axial alignment of drill rod 25 being loaded by the head assembly 24 with the drill string 44 in a bore hole. The device 45 allows the support arm 27 together with the grippers 29, 29' to rotate about the common central axis of the support arm 27 and the guide assemblies 30, 30' and thereby correct any axial misalignment between the drill rod 25 and the drill string 44.

Figure 7:
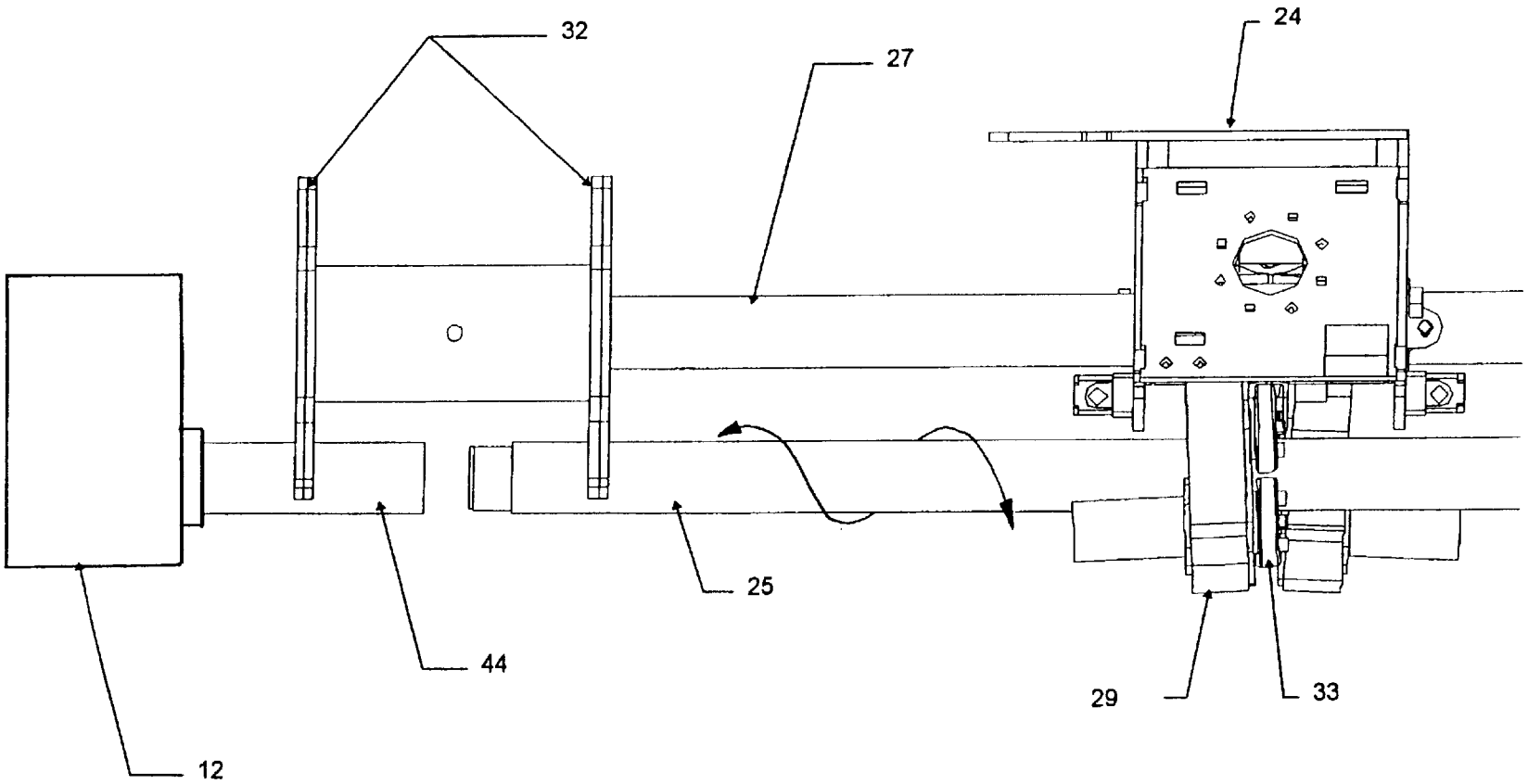
FIG. 7 is a schematic view showing the head assembly in the drill rod make/break position having been swung in behind the rotation unit of the feed frame from its side loading position.

The rod handing device 14 of this invention, which is powered by a hydraulic power pack 100, is used in the following manner:

- a drill rod 25 is placed in the front and rear guide assemblies 30, 30' with the pin thread midway between the front two guides 32 (refer FIG. 7). It will of course be appreciated that different guides are fitted depending on the size of the rod being used. This operation is normally done in a position near ground level (ie the load/unload position);
- the rod feeding mode is selected on the feeding/pulling switch on the control panel 46;
- the grippers 29 are then closed to hold the drill rod in the head assembly 24;
- the carriage 20 is then slidingly moved rearwardly along the guide rails 19 far enough back to clear the rear (or front) of the rotation unit 12;

the head assembly 24 is then tilted (rotated) until parallel with the feed frame the swing arm 21 along with the head assembly 24 are then swung inwardly, with the leading front guide member 32 locating on the drill string 44 protruding from the rear of the rotation unit 12;

when the transported drill rod 25 has been co-axially aligned with the drill string (ie in the make/break position), the rollers 33, 33' are rotated to screw the thread joint and thereby threadingly engage the drill rod 25 with the drill string 44;

once the thread joint is complete, the grippers 29 are opened and the device 14 returned to its load/unload position to one side of the feed frame 11;

the feed frame 11, rotation unit 12 and rod holder 13 are then used to feed the rods into the ground as per normal drill operating procedures.

This operation can be performed as many times as necessary:

In order to remove the drill rods from the drill string, the above procedure is simply reversed. In this case, however, the rod pulling mode is selected on the feeding/pulling switch on the control panel 46.

Desirably, sensors, eg proximity switches and a PLC unit linked to the control panel 46 are used as safety interlocks to prevent unwanted movement during certain operations. Also, an optional laser safety beam can be used to isolate the rod handler when operators are in its near vicinity.

Preferably a safety light is mounted and provides a visual flashing signal when the device 14 is operational.

A brief consideration of the above described embodiment will indicate that the invention provides a drill rod handler designed to aid the feeding of drill rods from their loading position adjacent the drill rig to their make/break position on the feed frame of the drill rig and which avoids the need for drilling assistants to handle heavy drill rods and drill string equipment at awkward angles and heights during the loading procedure. The device permits the drill assistant(s) to handle a larger number of drill rods with a reduced likelihood of fatigue and injury. The drill assistant will only be required to handle drill rods at or near ground level in loading same onto the head assembly prior to being transported to their make/break position on the feed frame.

The claims defining the invention are as follows:

1. A drill rod handling device adapted for attachment to feed frame of a drill rig assembly of the kind which includes a rotation unit and a rod holder mounted on top of the feed frame and which are used to feed drill rods in and out of the ground, said drill rod handling device comprising;

elongate guide means which extend longitudinally of the feed frame along one side thereof;

mounting means for attaching said guide means to said feed frame;

a carriage assembly guided for sliding movement lengthwise along said guide means;

drive means for effecting said sliding movement of the carriage assembly;

a head assembly comprising a head support frame, holder means for supporting a drill rod on the head assembly, gripper means for gripping the drill rod, when supported by said holder means, and means for feeding the drill rod, when thus supported, longitudinally;

a pivotal swing arm pivotally supported on said carriage assembly and extending laterally outwards therefrom;

swivel attachment means between the head support frame and the outer end of said swing arm whereby the head assembly can tilt relative to the swing arm about a transverse axis;

tilt actuator means for effecting said tilt movement of said head assembly;

swing actuator means for effecting bodily rotation of said swing arm and said head assembly about a generally longitudinal axis;

arranged and constructed so that a drill rod can be loaded, eg manually, onto the head assembly at a side load position relative to the feed frame, and bodily moved to a loading position on top of the feed frame for axial alignment with the drill string.

2. The drill rod handling device according to claim 1 wherein said holder means comprises an elongated support arm extending to opposite sides of the head support frame and attached thereto, and guide members mounted at or adjacent to the ends of the support arm for supporting the drill rod at spaced apart locations along its length and for guiding the drill rod longitudinally.

3. The drill rod handling device according to claim 2 wherein said means feeding the drill rod longitudinally comprises roller means.

4. The drill rod handing device according to claim 3 wherein each of said roller means comprises an assembly of rollers, at least one of which is driven by means of a hydraulic motor, said rollers when thus driven, being arranged to feed a drill rod axially for screwing or unscrewing of its thread joint.

5. The rod handing device according claim 1 wherein said guide means comprises a pair of parallel spaced apart elongated rails or rods along which the carriage assembly is guided for sliding movement by means of slides.

6. A drill rod handling device adapted for attachment to a feed frame of a drill rig assembly of the kind which includes a rotation unit and a rod holder mounted on top of the feed frame and which are used to feed drill rods in and out of the ground, said drill rod handling device comprising;

elongated guide means which extend longitudinally of the feed frame along one side thereof;

mounting means for attaching said guide means to said feed frame;

a carriage assembly guided for sliding movement lengthwise along said guide means;

drive means for effecting said sliding movement of the carriage assembly;

a head assembly comprising a head support frame, holder means for supporting a drill rod on the head assembly, gripper means for gripping the drill rod, when supported by said holder means, and roller means for feeding the drill rod longitudinally when thus supported, the holder means comprising an elongated support arm extending to opposite sides of the head support frame and attached thereto, and guide members mounted at or adjacent to the ends of the support arm for supporting the drill rod at spaced apart locations along its length and for guiding the drill rod longitudinally, and the gripper means comprising two opposing pivotal rod gripping jaws, each of which houses respective said roller means, said gripping jaws being moveable between open and closed positions by means of an hydraulic power cylinder mounted on the head support frame;

a pivotal swing arm pivotally supported on said carriage assembly and extending laterally outwards therefrom;

swivel attachment means between the head support frame and the outer end of said swing arm whereby the head assembly can tilt relative to the swing arm about a transverse axis;

tilt actuator means for effecting said tilt movement of said head assembly; and swing actuator means for effecting bodily rotation of said swing arm and said head assembly about a generally longitudinal axis;

arranged and constructed so that a drill rod can be loaded, eg manually, onto the head assembly at a side load position relative to the feed frame, and bodily moved to a loading position on top of the feed frame for axial alignment with the drill string.

7. The drill rod handling device according to claim 6 wherein said guide members on the support arm comprises radial approximately U-shaped supports fixedly attached to at or adjacent to the outer ends of the support arms.

8. The drill rod handling device according to claim 7 in combination with a hydraulic power pack for hydraulically powering the handling device and a remote electric control panel electrically connected to said power pack for selectively controlling its operation.

9. The drill rod handling device according to claim 8 wherein the head assembly further comprises drill rod self centering means arranged to permit the support arm and gripper means to rotate about the central axis of the support arm for axially aligning the drill rod with the drill string.

10. A drill rod handling device adapted for attachment to a feed frame of a drill rig assembly of the kind which includes a rotation unit and a rod holder mounted on top of the feed frame and which are used to feed drill rods in and out of the ground, said drill rod handling device comprising;

elongated guide means which extend longitudinally of the feed frame along one side thereof, the guide means comprising a pair of parallel spaced apart elongated guide rails or rods along which the carriage assembly is guided for sliding movement by means of slides;

mounting means for attaching said guide means to said feed frame;

a carriage assembly guided for sliding movement lengthwise along said guide means;

drive means for effecting said sliding movement of the carriage assembly;

a head assembly comprising a head support frame, holder means for supporting a drill rod on the head assembly, gripper means for gripping the drill rod, when supported by said holder means, and roller means for feeding the drill rod longitudinally when thus supported;

a pivotal swing arm pivotally supported on said carriage assembly and extending laterally outwards therefrom;

swivel attachment means between the head support frame and the outer end of said swing arm whereby the head assembly can tilt relative to the swing arm about a transverse axis;

tilt actuator means for effecting said tilt movement of said head assembly;

swing actuator means for effecting bodily rotation of said swing arm and said head assembly about a generally longitudinal axis; and said drive means for the carriage assembly comprising an hydraulic traverse cylinder mounted to one side of said guide means and extending parallel therewith, said traverse cylinder being arranged to move the carriage in a direction towards or rearwardly away from the rotation unit in the feed frame whereby the swing arm and head assembly can be moved to a position far enough away from the load/unload position so that they clear the back of the rotation unit on the feed frame and the rod string when making and breaking threads;

arranged and constructed so that a drill rod can be loaded, eg manually, onto the head assembly at a side load position relative to the feed frame, and bodily moved to a loading position on top of the feed frame for axial alignment with the drill string.

11. A drill rod handling device adapted for attachment to a feed frame of a drill rig assembly of the kind which includes a rotation unit and a rod holder mounted on top of the feed frame and which are used to feed drill rods in and out of the ground, said drill rod handling device comprising;

elongated guide means which extend longitudinally of the feed frame along one side thereof;

mounting means for attaching said guide means to said feed frame;

a carriage assembly guided for sliding movement lengthwise along said guide means;

drive means for effecting said sliding movement of the carriage assembly;

a head assembly comprising a head support frame, holder means for supporting a drill rod on the head assembly, gripper means for gripping the drill rod, when supported by said holder means, and roller means for feeding the drill rod longitudinally when thus supported;

a pivotal swing arm pivotally supported on said carriage assembly and extending laterally outwards therefrom;

swivel attachment means between the head support frame and the outer end of said swing arm whereby the head assembly can tilt relative to the swing arm about a transverse axis;

tilt actuator means for effecting said tilt movement of said head assembly; and swing actuator means for effecting bodily rotation of said swing arm and said head assembly about a generally longitudinal axis through an angle of approximately 180°;

arranged and constructed so that a drill rod can be loaded, eg manually, onto the head assembly at a side load position relative to the feed frame, and bodily moved to a loading position on top of the feed frame for axial alignment with the drill string.

* * * * *